US005513738A

United States Patent [19]

Hird et al.

[11] Patent Number: 5,513,738

[45] **Date of Patent: *May 7, 1996**

[54] COIN HANDLING SYSTEM

[75] Inventors: John A. Hird, Dallas; Mark E. Kerr, Wylie, both of Tex.

[73] Assignee: Intellicall, Inc., Carrollton, Tex.

[ * ] Notice: The term of this patent shall not extend beyond the expiration date of Pat. No. 5,255,770.

[21] Appl. No.: 143,187

[22] Filed: Oct. 26, 1993

Related U.S. Application Data

[63] Continuation of Ser. No. 758,897, Sep. 11, 1991, Pat. No. 5,255,770, which is a continuation of Ser. No. 594,272, Oct. 9, 1990, Pat. No. 5,090,548.

[51] Int. Cl.[6] ..... G07F 1/04

[52] U.S. Cl. ..... 194/345; 194/347

[58] Field of Search ..... 194/345, 346, 194/347, 348, 349, 321, 323

[56] References Cited

U.S. PATENT DOCUMENTS

| | | | |
|---|---|---|---|
| 1,317,953 | 10/1919 | Bodmer | 194/344 |
| 2,277,018 | 3/1942 | Patzer et al. | 194/323 |
| 2,292,472 | 8/1942 | Patzer et al. | 194/326 |
| 2,298,009 | 10/1942 | Grunig | 194/325 |
| 2,904,151 | 9/1959 | Johnson | 194/220 |
| 3,030,008 | 4/1962 | Jensen | 232/57.5 |
| 3,337,125 | 8/1967 | Nielsen | 232/57.5 |
| 3,372,864 | 3/1968 | Kovar | 232/57.5 |
| 3,810,575 | 5/1974 | Breitung et al. | 232/57.5 |
| 4,211,317 | 7/1980 | Bellis | 194/346 |
| 4,410,077 | 10/1983 | Okolischan | 194/344 |
| 4,687,090 | 8/1987 | Ramseier | 194/317 |
| 4,842,120 | 6/1989 | Dobbins et al. | 194/349 |

FOREIGN PATENT DOCUMENTS

| | | | |
|---|---|---|---|
| 2428528 | 2/1976 | Germany | 194/348 |
| 3345149 | 6/1985 | Germany | 194/349 |
| 1311396 | 12/1989 | Japan | 194/348 |
| 1334157 | 10/1973 | United Kingdom | 194/345 |

*Primary Examiner*—F. J. Bartuska
*Attorney, Agent, or Firm*—Baker & Botts

[57] ABSTRACT

A coin handling system prevents jamming of the coin chutes of coin operated machines and keeps foreign objects out of coin validators and other internal mechanisms of coin operated machines. A coin chute 15 guides coins into the coin validator 24. An exit end of coin chute 15 is moved from a rest position above the coin validator 24 to a position above a return chute 25. Coin chute 15 then separates into two pieces, causing large foreign matter to fall out of the coin chute 15. Foreign objects that are pushed into coin chute 15 are forced out of coin chute 15 by slots 30 formed on the back edge of coin chute 15. Foreign objects are thus prevented from going further into coin chute 15 and coin validator 24. A bevelled edge 29 is formed on an edge of chute piece 23, one of two pieces forming coin chute 15. Foreign objects are pushed into coin chute 15, it impacts bevelled edge 29, causing coin chute 15 to separate into two chute pieces. If the foreign object is thus forced out of coin chute 15 and prevented from moving into coin validator 24.

16 Claims, 3 Drawing Sheets

COIN HANDLING SYSTEM

CROSS REFERENCE TO RELATED APPLICATIONS

This application is a continuation application of U.S. application Ser. No. 07/758,897, filed Sep. 11, 1991 and entitled "Coin Handling System", pending, which is a continuation of application Ser. No. 07/594,272, filed Oct. 9, 1990 and entitled "Coin Handling System", now U.S. Pat. No. 5,090,548 issued Feb. 25, 1992.

TECHNICAL FIELD OF THE INVENTION

This invention relates in general to the field of coin handling systems and more particularly to an improved coin handling system for use in conjunction with electronic coin validators in coin operated machines.

BACKGROUND OF THE INVENTION

Jammed coin handlers present a serious problem for coin operated machines. For example, it is estimated that 80% of service calls for pay telephones are to repair jammed coin handlers within the telephones. In pay telephones, the coin handlers are typically jammed by thieves who stuff matchbooks, partially inflated balloons or other foreign objects into the coin chute. These foreign objects cause the coin chute to fill up with coins as pay telephone callers unsuccessfully attempt to use the telephone. The thief retrieves these coins by pushing a coat hanger, a dip stick or other similar object into the coin chute and forcing the coins through an adjacent coin validator and into a coin return slot.

Intentional jamming of coin handlers causes significant revenue loss to owners of coin operated machines. In addition, thieves and vandals often cause serious damage to coin operated machines by forcing foreign objects into coin validators and other internal mechanisms of the coin machines.

Accordingly, a need has arisen for a coin handling system that prevents the intentional or accidental jamming of a coin operated machine and that safeguards the machine from potential damage from attempts to jam the machine.

SUMMARY OF THE INVENTION

In accordance with the teachings of the present invention, a coin handling system is provided which prevents the jamming of foreign objects and coins in coin operated machines and prevents foreign objects forced into the machines from entering and damaging coin validators and other internal mechanisms of the machines.

The coin handling system of the present invention comprises a coin chute that can be divided into two separate pieces to clear coins and other objects lodged in the chute. The coin chute can easily be cleared by a "sweep and clear" mechanism. When a coin release lever outside the machine is actuated, the coin chute rotates from its biased rest position, usually above the entry to an electronic coin validator, to a position above a trash and coin return chute. When it is at this second position, the coin chute separates, releasing the lodged coins and foreign objects.

An important technical advantage of the present invention is that it prevents theft by intentional jamming of coin operated machines. If foreign material is lodged into the chute by a thief to block the passage of and to collect coins inserted by later users, the foreign material can be easily cleared by activating the "sweep and clear" operation of the invention. No coins will accumulate for the thief. A further technical advantage of the present invention is that activation of the "sweep and clear" operation also activates a clearing mechanism in the coin validator so that the coin validator can be simultaneously cleared.

According to another aspect of the invention, ridges are integrated in the inner surfaces of the coin chute. These ridges tend to trap foreign material in the upper portions of the chute, preventing the foreign material from traveling further along the coin path. These ridges also prevent wet coins from sticking to the inner surfaces of the coin chute.

According to further aspects of the present invention, features are included to prevent foreign objects like coat hangers and dip sticks from entering and damaging coin validators and other internal mechanisms of coin operated machines. First, the coin chute may comprise a multidirectional shape such that coins or other objects attempting to pass through the chute must change directions and consequently impact a wall of the chute. According to one embodiment of the present invention, the multidirectional shape comprises an L-shape such that foreign object cannot be guided through the chute without impacting a back wall of the chute near the single bend in the chute. Additionally, the back end of the coin chute may comprise several slots. When a dip stick, a coat hanger or other similar object is forced into the chute, the slots deflect the object through them rather than allowing the object to go further into the chute. Finally, the rear edge of one of the two pieces that forms the chute may be bevelled. When an object like a dip stick is forced against the bevelled area, the chute separates and causes the object to leave the chute rather than travel down the chute into the internal mechanisms disposed below the chute. These elements of the invention prevent foreign objects from entering and damaging coin validators and other internal mechanisms of coin operated machines.

BRIEF DESCRIPTION OF THE DRAWINGS

The objects and advantages of the present invention are more readily apparent when the following detailed description is read in conjunction with the accompanying drawings; wherein.

DETAILED DESCRIPTION OF THE PREFERRED EMBODIMENT

Figure 1:
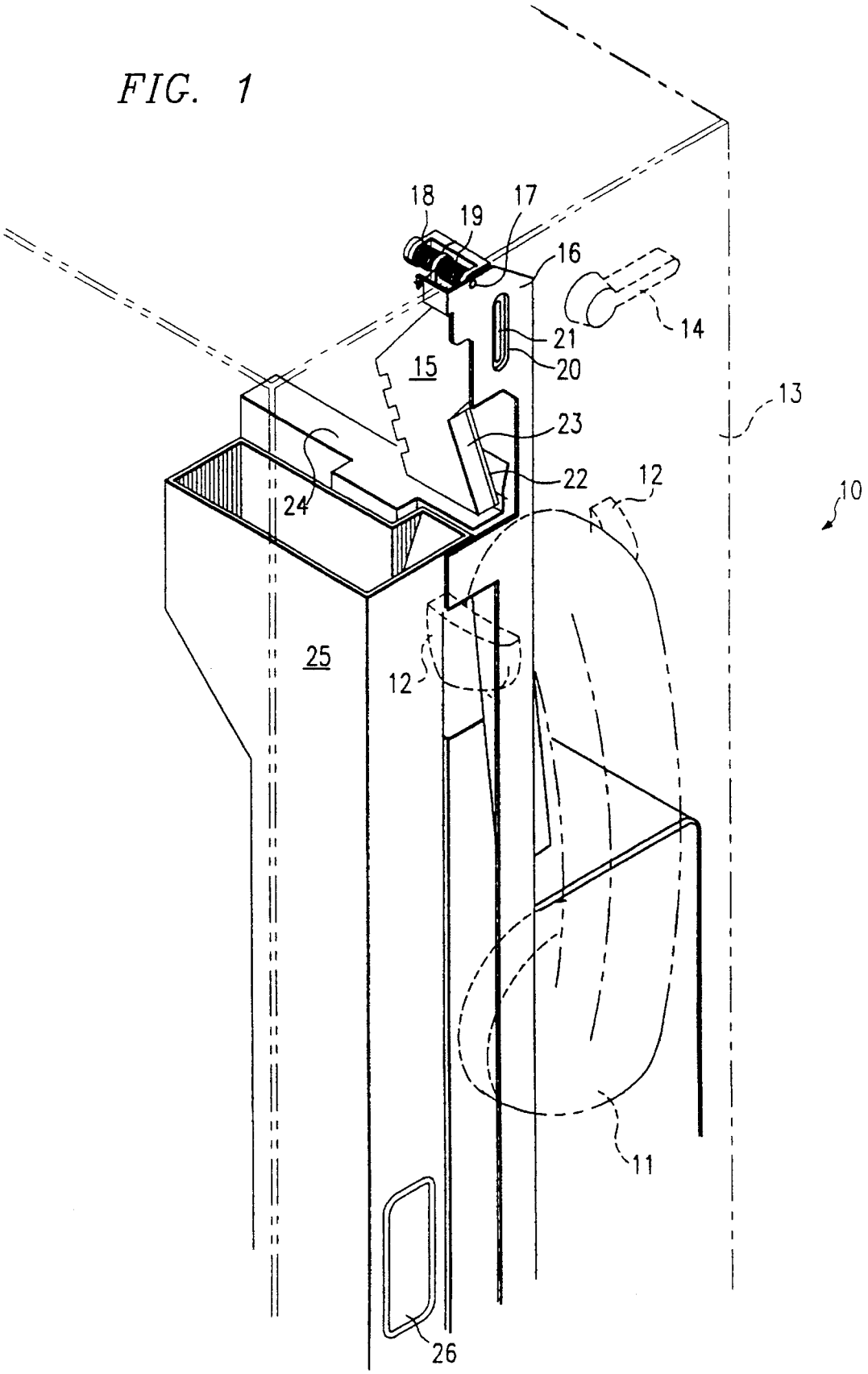
FIG. 1 is a three dimensional view showing the location and position of the coin handling system of the present invention in a pay telephone.

FIG. 1 shows an embodiment of the present invention as it may be used in a generally indicated pay telephone 10. Pay telephone 10 comprises a receiver 11 which, when not in use, is placed on a cradle 12. Cradle 12 is mounted to the outside of a chasis 13. A coin release lever 14 is pivotally connected to the outside of chasis 13. Coin release lever 14 is connected by a linkage (not shown) to a coin chute 15. The top of coin chute 15 is pivotally connected to a bracket 16, which is mounted on the inside of chasis 13. A pivot pin 17 is used to connect coin chute 15 to bracket 16. A first biasing spring 18 and a second biasing spring 19 are wound around pivot pin 17. A first coin slot 20 is formed in bracket 16. A second coin slot 21 is aligned with first coin slot 20 and forms the entry to coin chute 15.

Coin chute 15 comprises a first chute piece 22 and a second chute piece 23. First and second chute pieces 22 and 23 are biased together by first biasing spring 18. Coin chute 15 is biased into a vertical position by second biasing spring 19. When in its vertical position, coin chute 15 is disposed directly above the entry to a coin validator 24 which is also mounted on bracket 16. Coin validator 24 may comprise, for example, an "MS16" model coin validator manufactured by Mars Electronics. Coin validator 24 functions to electronically detect counterfeit coins as well as to determine the value of coins inserted by a patron. It should be understood that while the preferred embodiment comprises an electronic coin validator, any type of coin validator may be used to determine the value of coins deposited including those functioning mechanically or optically. Coin validator 24 selectively routes coins to a coin box (not shown) or a coin return box 26. The internal mechanisms of coin validator 24 can be easily damaged by foreign objects forced through coin validator 24. A trash and coin release chute 25 is positioned adjacent to coin validator 24, such that coin chute 15 can be rotated from its position above coin validator 24 to a position in which its lower end is above trash and coin return chute 25. At the lower end of trash and coin return chute 25 is a coin return box 26, from which a telephone user can retrieve coins and foreign objects that have been jammed in and dislodged from coin chute 15.

Figure 2:
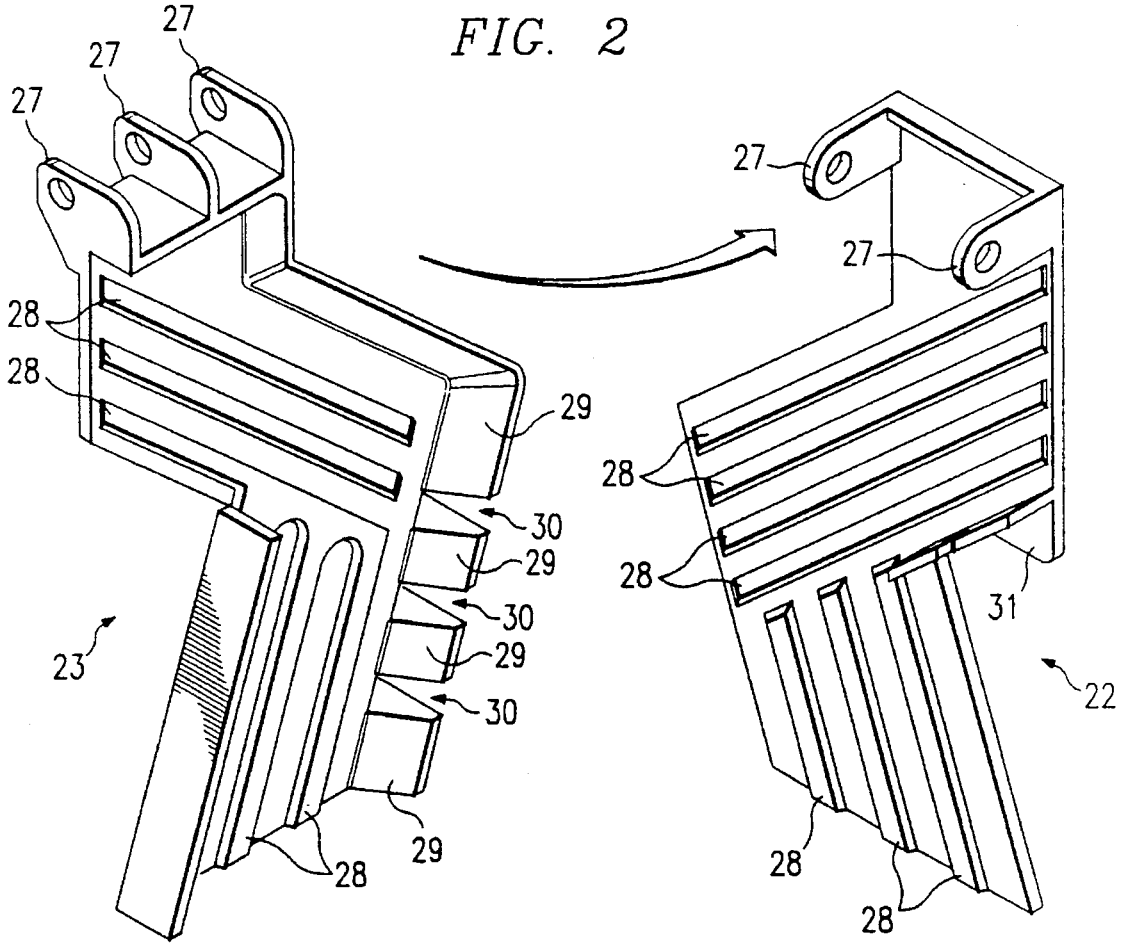
FIG. 2 is an exploded view of the coin chute used in the present invention.

FIG. 2 is an exploded view of coin chute 15, showing first coin chute piece 22 and second coin chute piece 23. Both chute piece 22 and chute piece 23 have pivot pin holders 27 formed at their upper edges. Pivot pin 17 fits in pivot pin holders 27, pivotally coupling first chute piece 22 to second chute piece 23. Both first chute piece 22 and second chute piece 23 also have ridges 28 formed on their interior surfaces. Second chute piece 23 has a bevelled edge 29 formed on its rear edge. Second chute piece 23 also contains slots 30 formed in and generally shown on the rear edge. A stop plate 31 is formed near the center of the front edge of chute piece 22.

When the pay telephone 10 is used normally, the phone user inserts a coin in coin slot 20, which is aligned with coin slot 21 at the entry to coin chute 15. The coin rolls through coin chute 15 and enters coin validator 24, which is directly beneath coin chute 15 when coin chute 15 is in its normal rest position. The coin validator then examines the coin to determine whether it is sufficient to allow the caller to use the phone.

Figure 5:
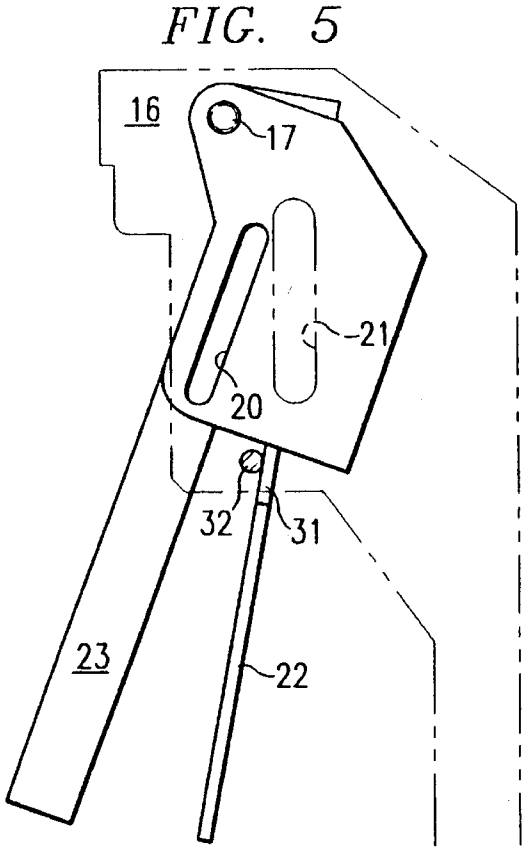
FIG. 3, 4 and 5 are sequential diagrams which illustrate the operation of the invention's "sweep and clear" mechanism.
Figure 4:
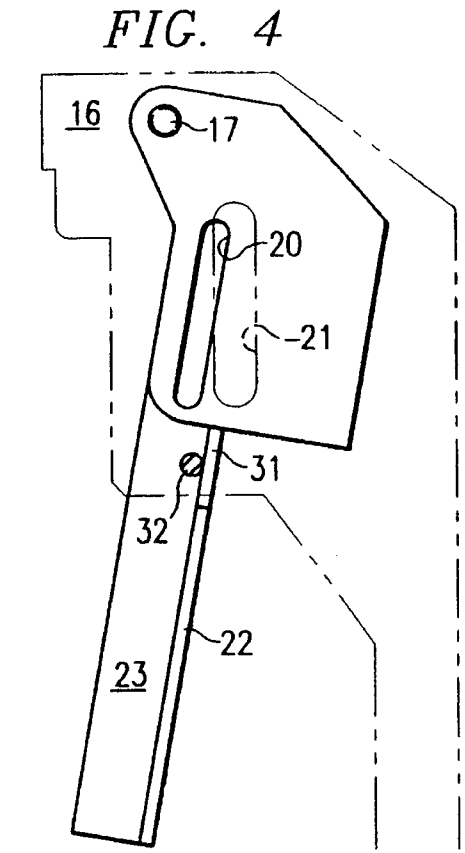
Figure 3:
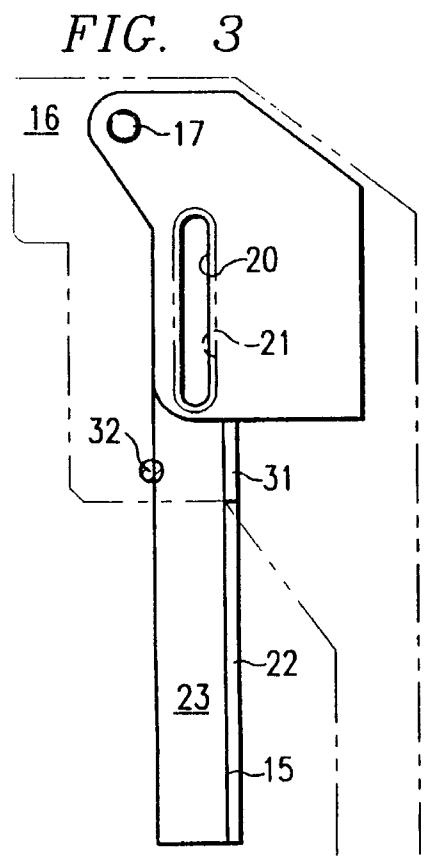

In the event coin chute 15 is jammed with foreign objects or coins, coin chute 15 can be easily cleared by the "sweep and clear" operation of the present invention. FIGS. 3, 4 and 5 are sequential diagrams which illustrate the "sweep and clear" operation. FIG. 3 is a front view of coin chute 15 in its biased vertical rest position in which the bottom end of coin chute 15 is directly above the entry to coin validator 24. Coin chute 15 is biased in this rest position by second biasing spring 19. First coin chute piece 22 and second coin chute piece 23 are biased together to form coin chute 15 by first biasing spring 18.

To activate the sweep and clear operation, the user of pay telephone 10 depresses coin release lever 14. This causes the coin chute 15, which is pivotally connected at its top to bracket 16, to rotate from its rest position to a second position in which the exit end of coin chute 15 is above the trash and coin return chute 25 as shown in FIG. 4. When the coin chute 15 reaches this second position, stop plate 31 of first chute piece 22 engages a stop 32 fixed with respect to bracket 16 which prevents first chute piece 22 from further rotation. Second chute piece 23 is unhindered by stop 32 and rotates away from first chute piece 22 as shown in FIG. 5. When the chute 15 is in this divided position, coins or foreign matter jammed in coin chute 15 are dislodged into the trash and coin return chute 25. When the telephone user releases coin release lever 14, chute 15 closes and rotates pack into the biased rest position shown in FIG. 3. Coin release lever 14 is connected to and controls the movement of coin chute 15 by means of a suitable linkage (not shown).

According to another aspect of the present invention, coin validator 24 may itself comprise a clearing system operable to clear foreign objects trapped in the coin path of coin validator 24. For example, the entrance to coin validator 24 may comprise hinged sidewalls (not shown) to allow for the clearing of foreign objects which somehow become jammed in coin validator 24. Through the use of an appropriate linkage (not shown), any clearing features of coin validator 24 can be actuated after coin chute 15 is moved to the position shown in FIG. 4. Accordingly, any foreign objects jammed in coin chute 15 as well as any foreign objects jammed in coin validator 24 may be cleared simultaneously.

An important technical advantage of the present invention inheres in the fact that coin chute 15 comprises a multidirectional shape such that coins passing through chute 15 are forced to change directions during their passage. This shape results in the fact that it is difficult to negotiate foreign objects such as dipsticks, coat hangers or the like through chute 15 and any such objects will necessarily be forced into a wall of chute 15 if such a procedure is attempted. Chute 15 is shown comprising an L shape, however, chute 15 may comprise a variety of arcuate or other multidirectional shapes. The general L shape of chute 15 is shown solely for the purpose of teaching the present invention and should not be construed to limit the scope of the present invention to this or any specific embodiment.

An additional technical advantage of the coin handling system of the present invention inheres in the fact that the back edge of chute piece 23 is bevelled. When a foreign object like a coat hanger or dipstick is forced into coin chute 15, due to the multidirectional shape discussed previously, it impacts the bevelled edge 29, causing chute piece 23 to separate from chute piece 22. As a result of this separation, the coat hanger or other object is forced to leave coin chute 15 and prevented from going further into coin chute 15 or into coin validator 24.

The same object is accomplished by the slots 30 located in the back edge of chute piece 23. When a coat hanger, dipstick or similar object is forced into coin chute 15, the slots 30 cause the foreign object to protrude one of the slots and prevent it from going further into chute 15 or into coin validator 24.

A third aspect of the present invention is the set of ridges 28 formed on the inside surface of chute piece 22 and chute piece 23. Ridges 28 function to trap foreign material in the upper portion of chute 15, preventing such foreign material from passing through chute 15 until the "sweep and clear" operation of the present invention is implemented. Additionally, ridges 28 reduce the surface area of chute 15 that comes into contact with coins and, as a result, prevent wet coins from sticking to the insides of coin chute 15.

These aspects of the present invention prevent intentional jamming of coin handlers and protect the internal mechanisms of coin operated machines from foreign objects that are forced into coin chutes. If a thief jams a foreign object like a matchbook into coin chute 15 in order to prevent passage of coins into coin validator 24, chute 15 can be easily cleared by the invention's "sweep and clear" operation. By simply depressing coin release lever 14 coin chute 15 can be moved and separated into two pieces, allowing the matchbook or other objects to fall out into trash and coin return chute 25. As a result, coins do not accumulate for thieves. The phone 10 is then ready for normal operation. Other aspects of the present invention protect internal mechanisms like coin validator 24 from foreign objects that may be forced into coin chute 15. Foreign objects forced into chute 15 impact bevelled edge 29, causing first chute piece 22 and second chute piece 23 of chute 15 to separate. As a result, foreign objects are forced to leave chute 15 rather than being allowed to go further into chute 15 or coin validator 24. The same objective is accomplished by slots 30 formed on the rear edge of chute piece 23. Slots 30 cause foreign objects like coat hangers forced into coin chute 15 to protrude one of the slots and leave chute 15 rather than go further into it or coin validator 24. Another aspect of the present invention is the set of ridges 28 formed on the interior surfaces of coin chute 15. These ridges reduce the surface area of chute 15 that comes into contact with coins and, as a result, prevents wet coins from sticking to coin chute 15.

Although the present invention has been described in detail, it should be understood that various changes, substitutions and alterations can be made hereto without departing from the spirit and scope of the invention as defined by the appended claims.

What is claimed is:

1. A coin handling system for use in a coin operated machine having a coin validator comprising:

a chute for guiding coins into the coin validator, said chute comprising an exit end proximate the coin validator, said chute comprising a multidirectional shape for forcing objects passing through said chute to change directions as the objects move through said chute, thereby inhibiting movement of objects other than coins through said chute, said chute comprising first and second chute pieces pivotally connected at their ends, each of said chute prices comprising an opposite sidewall of said chute;

means for biasing said first and second chute pieces together to form said chute;

means for moving said exit end of said chute from a first position proximate the coin validator to a second position away from the coin validator and dividing said first and second chute pieces after said chute reaches said second position for clearing said chute of any objects jammed therein; and said biasing means maintaining said first and second chute pieces together to form said chute and hold foreign objects within said chute until said exit end has moved to said second position.

2. The coin handling system of claim 1, wherein said chute generally comprises an "L" shape.

3. The coin handling system of claim 1, wherein said chute comprises a backwall having a slot formed therein so that foreign objects passing through said chute and impacting said backwall are deflected through said slot.

4. The coin handling system of claim 1, wherein said chute comprises interior surfaces having ridges formed therein to prevent wet coins from sticking to said surfaces.

5. A pay telephone comprising:

a coin validator operable to validate coins inserted into the pay telephone;

a coin chute for guiding coins into said coin validator, said chute comprising an exit end proximate the coin validator, said coin chute comprising a multi-directional shape so that objects passing through said coin chute are forced to change directions, thereby inhibiting movement of objects other than coins through said coin chute, said coin chute comprising first and second chute pieces pivotally coupled together at their ends to allow said chute pieces to divide, each of said chute pieces comprising an opposite sidewall of said coin chute;

means for biasing said first and second chute pieces together to form said coin chute;

a return chute;

means for moving said exit end of said coin chute from a rest position proximate said coin validator to a second position proximate said return chute and dividing said first and second chute pieces after said coin chute reaches said second position to clear said coin chute of any objects lodged therein; and said biasing means maintaining said first and second chute pieces together to form said chute and hold foreign objects within said chute until said exit end has moved to said second position.

6. The pay telephone of claim 5, wherein said coin chute comprises a generally "L" shape.

7. The pay telephone of claim 5, wherein said coin chute comprises interior surfaces having ridges formed thereon to prevent wet coins from sticking to said surfaces.

8. The pay telephone of claim 5, wherein said coin chute comprises a backwall having a plurality of slots formed therein such that foreign objects passing through said coin chute and impacting said backwall are deflected through said slots.

9. The pay telephone of claim 5, wherein said coin validator comprises a clearing system for clearing objects jammed in said coin validator and a means for activating said clearing system when said exit end of said coin chute has been moved to said second position.

10. A coin operated machine, comprising:

an electronic coin validator;

a chute for guiding coins into said coin validator, said chute comprising an exit end proximate the coin validator, said chute comprising a multidirectional shape for forcing objects passing on a path through said chute to change directions as the objects move through said chute, said chute comprising first and second chute pieces pivotally coupled together at one end to allow said chute pieces to divide, each of said chute pieces comprising an opposite sidewall of said chute, said of said chute pieces comprising an opposite sidewall of said chute;

a biasing spring for biasing said first and second chute pieces together to form said chute;

a return chute; and a coin return lever operable to divide said first and second chute pieces and operable to move said exit end of said coin chute from a rest position proximate said coin validator to a second position proximate said return chute to clear said coin chute of any objects lodged therein.

11. The coin operated machine of claim 10, wherein-the interior surfaces of said chute pieces comprise ridges operable to prevent wet coins from sticking to said surfaces.

12. The coin operated machine of claim 10, wherein said coin chute comprises a generally "L" shape.

13. The coin operated machine of claim 10, wherein said return chute comprises a trash chute operable to receive objects dislodged from said coin chute.

14. A coin handling system for use in a coin operated machine having a coin validator, comprising:

a chute for guiding coins into the coin validator, said chute comprising an exit end proximate the coin validator, said chute comprising a multidirectional shape for forcing objects passing on a path through said chute to change directions as the objects move through said chute, said chute comprising first and second chute pieces, each of said chute pieces comprising an opposite sidewall of said chute, said chute comprising a coin entry operable to receive coins in an orientation defining a first plane;

first and second biasing means, said first biasing means operable to hold said first and second chute pieces together to form said chute and said second biasing means operable to position said exit of said chute proximate the coin validator; and a surface integral with one of said chute pieces, said chute pieces defining a plane askew with respect to said first plane such that said first and second chute pieces separate if said surface is forcibly impacted by a foreign object inside said chute, thereby forcing said foreign object to exit said chute between said separated chute pieces.

15. A coin handling system for use in a coin operated machine having a coin validator, comprising:

a chute for guiding coins into the coin validator, said chute comprising an exit end proximate the coin validator, said chute comprising a multidirectional shape for forcing objects passing on a path through said chute to change directions as the objects move through said chute, said chute comprising first and second chute pieces, said first and second chute pieces being pivotally coupled at an end of said first and second chute pieces opposite said exit end, each of said chute pieces comprising an opposite sidewall of said chute, said chute comprising a coin entry operable to receive coins in an orientation defining a first plane;

first and second biasing means, said first biasing means operable to hold said first and second chute pieces together to form said chute and said second biasing means operable to position said exit of said chute proximate the coin validator.

16. The coin handling system of claim 15, wherein said first and second chute pieces each comprise at least two pivot points at said end opposite the exit end.

* * * * *